United States Patent [19]

Traver

[11] 3,967,780

[45] July 6, 1976

[54] AIR CONDITIONING SYSTEM

[75] Inventor: Darwin G. Traver, DeWitt, N.Y.

[73] Assignee: Carrier Corporation, Syracuse, N.Y.

[22] Filed: Dec. 9, 1975

[21] Appl. No.: 530,577

Related U.S. Application Data

[62] Division of Ser. No. 311,076, Dec. 1, 1972, Pat. No. 3,867,980.

[52] U.S. Cl. ..... 236/49; 98/40 D; 236/91 D

[51] Int. Cl.[2] ..... F24F 13/06; F24F 11/04

[58] Field of Search ..... 236/49, 91; 98/40 D, 98/40 C; 165/28

[56] References Cited

UNITED STATES PATENTS

| | | | |
|---|---|---|---|
| 3,623,543 | 11/1971 | Ostrander | 165/26 |
| 3,815,486 | 6/1974 | Morrison | 98/40 D |

*Primary Examiner*—William E. Wayner

*Attorney, Agent, or Firm*—J. Raymond Curtin; Barry E. Deutsch

[57] ABSTRACT

An air conditioning system including a ceiling air terminal operable to discharge conditioned air into a room and adapted to be connected to first and second sources of conditioned air. The first source provides air at a temperature level which varies inversely to changes in the outdoor air temperature. The air is discharged from the terminal along the ceiling towards the peripheral wall of the room to compensate for transmission gains or losses. The second source provides air at a predetermined temperature level. The air is discharged from the terminal along the ceiling of the room towards the interior thereof to compensate for the remaining cooling load therein, the volume of the air being varied in accordance with changes in the cooling load. The volume of the variable temperature air discharged into the room is maintained constant irrespective of changes in the pressure of the air supplied to the terminal.

2 Claims, 3 Drawing Figures

AIR CONDITIONING SYSTEM

This is a division, of application Ser. No. 311,076 filed Dec. 1, 1972, now U.S. Pat. No. 3,867,980.

BACKGROUND OF THE INVENTION

This invention relates to air conditioning systems for conditioning the air in a plurality of areas or spaces in a common enclosure, and more particularly, relates to a ceiling air terminal which is provided for delivering the conditioned air into an individual space.

In recent years many multi-zone buildings, such as schools, offices, apartments, and hospitals have employed central station air conditioning systems to provide conditioned air to regulate the psychometric properties of the air in each of the zones of the building. One air conditioning system that has enjoyed widespread commercial success is known as a dual conduit system. A dual conduit system is designed to supply two air streams to enclosed areas or rooms that have a reversing transmission load; that is, during summer, heat flows from the ambient air into the building, whereas during winter, heat flows from the building to the ambient air. One air stream, called the secondary air is cooled the year round and is constant in temperature and variable in volume. The other air stream, called the primary air, is constant in volume and the air temperature is varied; it is warm in winter and cool in summer. Primary air is, therefore, a constant volume-variable temperature air stream. To obtain the two air streams, central station apparatus are employed to provide the air temperature and volumes required.

The primary air apparatus varies the psychometric properties of the air supplied thereto, which may comprise a mixture of outdoor and return air. The apparatus includes filters to remove dirt or foreign matter entrained in the air, preheat coils as required to temper cold winter air, a humidifier to add winter humidification and a dehumidifier to remove excess moisture and to cool the supply air furnished at a constant volume to the enclosed areas contained in the building.

The secondary air apparatus also varies the psychometric properties of the air supplied thereto and supplies either all return air, a mixture of outdoor and return air, or all outdoor air, depending upon the season. The apparatus contains filters to remove dirt or foreign matter entrained in the air and a dehumidifier to remove excess moisture and/or to cool the supply air.

A refrigeration machine is necessary to complete the overall system. Any of the three basic refrigeration cycles, absorption, reciprocating, or centrifugal may be considered for the refrigeration equipment. Either chilled water from the refrigeration machine or direct expansion of refrigerant may be used to obtain a desired temperature for the supply air. The foregoing system is completely described in U.S. Pat. No. 2,609,743, issued Sept. 9, 1952, in the names of Carlyle M. Ashley and William T. McGrath.

Heretofore, it has been the practice to provide at least two separate air discharge terminals in each of the individual enclosed spaces. One of the terminals is connected to the source of primary air and serves the peripheral portion of the space or room. The other terminal is connected to the source of secondary air and serves the interior portion of the space. The initial cost for the air conditioning system heretofore described has thus been relatively expensive. In addition, the terminal servicing the peripheral portion of the room has heretofore been typically installed under the window or adjacent to the peripheral wall, thus generally occupying a portion of the otherwise usable floor space of the room. Furthermore, since the peripheral terminals have been so installed, architects have been somewhat inhibited in designing buildings having dual conduit systems.

SUMMARY OF THE INVENTION

It is therefore an object of this invention to decrease the initial cost of providing a dual conduit system.

It is a further object of this invention to utilize a single ceiling air discharge terminal to provide conditioned primary and secondary air into each of the enclosed spaces.

It is yet another object of the present invention to provide a ceiling air terminal which effectively discharges primary air to either heat or cool the peripheral portion of an enclosed space, and in addition effectively discharges secondary air to cool the interior portion of the enclosed space.

These and other objects of the present invention are obtained by providing a dual conduit air conditioning system. The system includes a source of primary air and a source of secondary air. The source of primary air is connected by suitable conduit means to a first portion of a plenum which is provided in the ceiling of the space being conditioned. The source of secondary air is provided by suitable means to a second portion of the plenum. The primary air is maintained separate from the secondary air.

Diffuser means are operably connected to the plenum for discharging the primary air and secondary air streams into the space. The diffuser means discharge the primary air from the air terminal so that it is directed towards the peripheral wall of the space and flows along the ceiling thereto. The diffuser means further operates to discharge the secondary air along the ceiling of the space so that it is directed towards the interior portion thereof. First regulating means are operably connected to the diffuser means to maintain the discharge of primary air at a substantially constant volume irrespective of changes in the pressure in the first portion of the plenum. Additionally, second regulating means are associated with the diffuser means to vary the discharge of secondary air into the space in accordance with the changes of the cooling load therein.

DESCRIPTION OF THE PREFERRED EMBODIMENT

Figure 1:
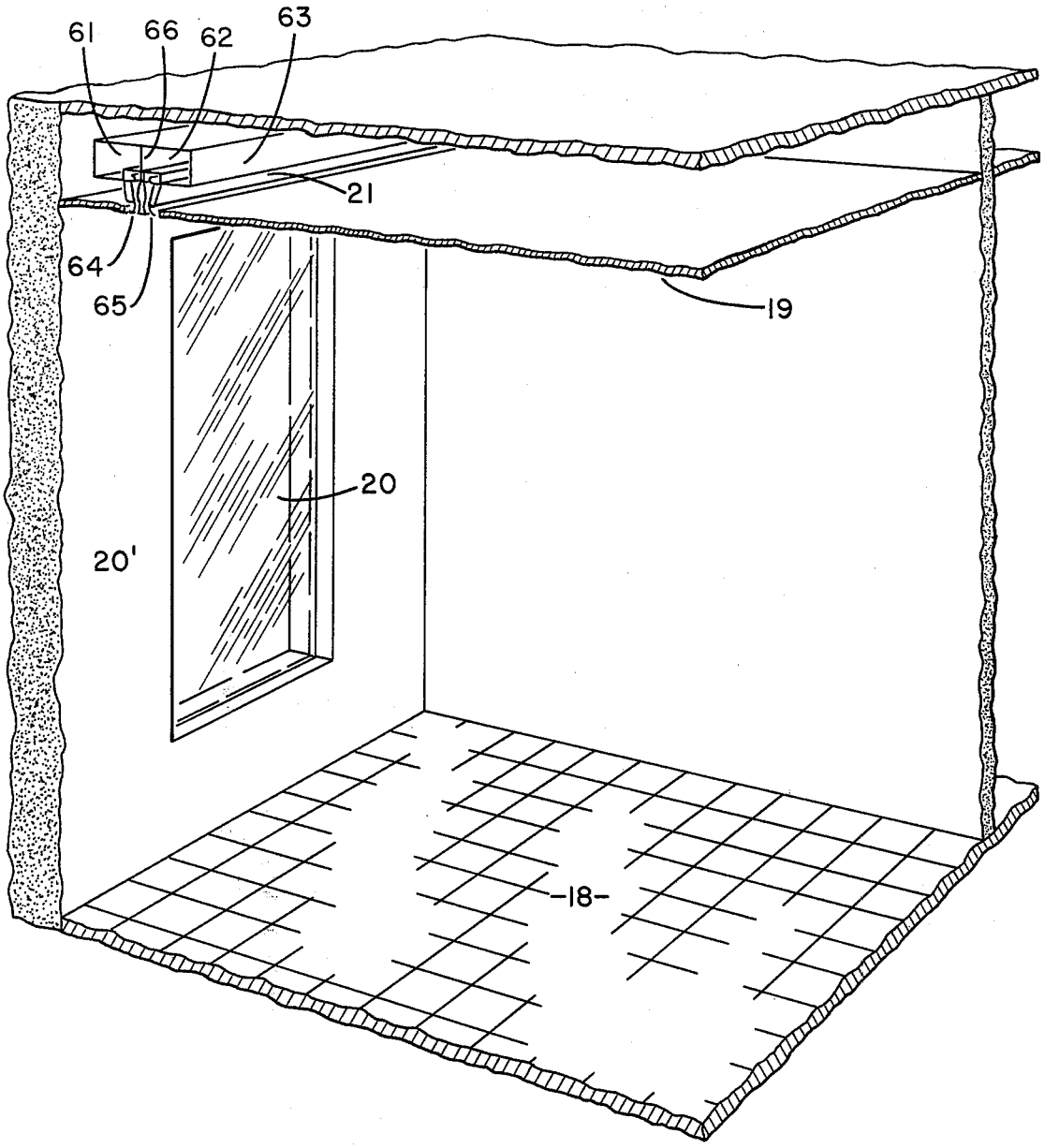
FIG. 1 of the drawing illustrates a typical space in a building wherein the air terminal of the present air conditioning system may be employed.

Referring now to the drawings, and in particular to FIG. 1 thereof, there is shown an enclosed space 18, which may be a room or area in an office building or similar structure. Room 18 includes a peripheral wall 20' having window 20 therein. The room further includes a ceiling 19. Typically, in the modern office building, ceiling 19 comprises a plurality of acoustical tiles 19' which are suspended from the actual ceiling, the acoustical tiles defining a "false" ceiling.

A ceiling air terminal 21 is disposed in the space between the false ceiling and the actual ceiling. Ceiling air terminal 21 is operable to discharge conditioned air in a manner that shall be more fully explained hereinafter to condition room 18 to a desired temperature and humidity level.

Figure 2:
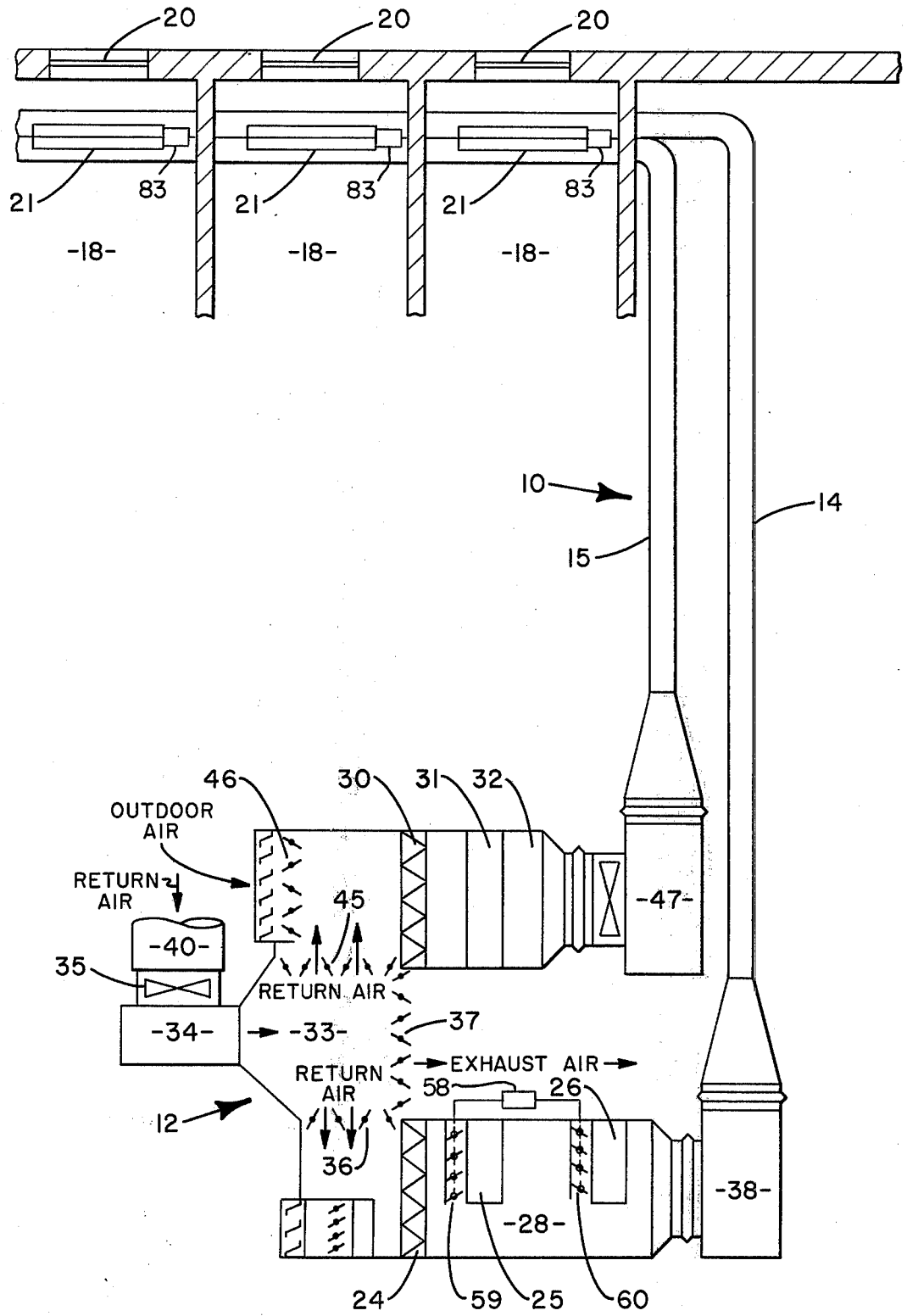
FIG. 2 schematically illustrates the air conditioning system in accordance with the present invention.

Referring now to FIG. 2 there is shown an air conditioning system including terminal 21 in accordance with the present invention. The air conditioning system 10, which may be described as a central station type, includes an air conditioning equipment section designated generally by the numeral 12, and a conduit system 14, 15, for conducting conditioned primary and secondary air, respectively, to each of the areas or rooms 18 of the building served by the air conditioning system. Equipment section 12 may be in a basement or on the roof of the building.

For the purpose of this description, primary air may comprise fresh air or ventilating air drawn from the outdoors, or a mixture of outdoor air and return air treated in section 12, while secondary air may comprise return air from the areas being conditioned and treated in section 12. The apparatus for conditioning the primary air preferably includes a filter 24 to remove foreign matter entrained in the air, heating or reheating coil 26 to elevate the temperature of the air flowing in the primary air system or circuit and a cooling or dehumidifying coil 25 to remove excess moisture and to cool the supply air as required, arranged in series flow relationship and encased within a suitable housing 28. The passage of primary air over coils 25 and 26 is regulated by dampers 59 and 60. Dampers 59 and 60 are pneumatically controlled in response to the outdoor air temperature as sensed by thermostat 58. The position of the dampers will be regulated to direct the air through either coils 25 or 26, or to bypass the coils, to provide a supply air temperature which substantially varies inversely to the temperature of the outdoor air as sensed by thermostat 58.

The portion of such central station equipment regulating the secondary air preferably includes a suitable filter 30 to remove foreign matter entrained in the air and a dehumidifier or cooling coil 31 to remove the excess moisture and/or cool the supply air, arranged in series flow relationship and encased within a suitable housing 32. Chilled water is supplied to coils 25 and 31 via suitable means (not shown).

Housings 28 and 32 are connected by duct 33 with return air exhaust fan 34. The inlet of fan 34 is connected with return air plenum 40, which is connected by suitable means (not shown) with the areas or enclosed rooms 18 being served by air conditioning system 10. Preferably, inlet air control vanes 35 are provided to vary the flow of air through fan 34. Adjustable vanes 36 are provided to vary the flow of return air to the primary air conditioning apparatus. Exhaust dampers 37 connect duct 33 with the outdoors. Dampers 37 control the volume of return air discharged to the atmosphere. Housing 28 connects with primary air fan 38. Conduit means 14 conveys primary air from fan 38 to the areas or rooms 18 being conditioned. Housing 32 is connected to the outlet of return air fan 34. Preferably adjustable vanes 45 are provided to vary the flow of supply air to the secondary air conditioning apparatus. Adjustable vanes 46 are provided to regulate the flow of outdoor air to the secondary air conditioning apparatus. Conduit means 15 conveys air from fan 47 to the area or rooms being conditioned. Conduit means 14 and 15 provide the primary air and secondary air to each ceiling air terminal 21; a single air terminal being disposed in each of the rooms 18.

With reference to FIG. 1 it is clearly observed that ceiling air terminal 21 is disposed relatively close to peripheral wall 20' of room 18. Conduit means 14 is connected to a first portion 61 of plenum 63 of the terminal. Conduit means 15 is connected to a second portion 62 of plenum 63. Thus, primary air, whose temperature may be varied in accordance with changes in temperature of the ambient air outside the enclosure, is discharged from plenum portion 61 through diffuser section 64 of the unit and flows along the ceiling 19 towards peripheral wall 20'. The discharged air then flows along the wall 20' to thus blanket window 20 and wall 20' with a layer of conditioned air. The temperature of the air will compensate for transmission gains or losses that will occur as a result of conduction through the peripheral wall, and in particular through the window of the room.

Furthermore, it has been determined that air discharged from the unit will establish an air circulation pattern that will prevent any cold air flowing into the room and not neutralized by the temperature of the primary air, from creating undesirable down drafts. Such cold air will be recirculated in the air current created by the flow of primary air across the ceiling.

The secondary air will be discharged from plenum 62 via diffuser means 65 which will direct the air along the ceiling towards the interior portion of room 18. As noted before, the temperature of the secondary air is maintained relatively constant. Suitable means (not shown) will sense the temperature of the room and will vary the quantity of air discharged from the unit to maintain the temperature in the room at a predetermined level.

A baffle or partition member 66 divides plenum 63 into first and second portions 61 and 62 and thus maintains primary air separate from secondary air so that there is no intermixing therebetween.

Figure 3:
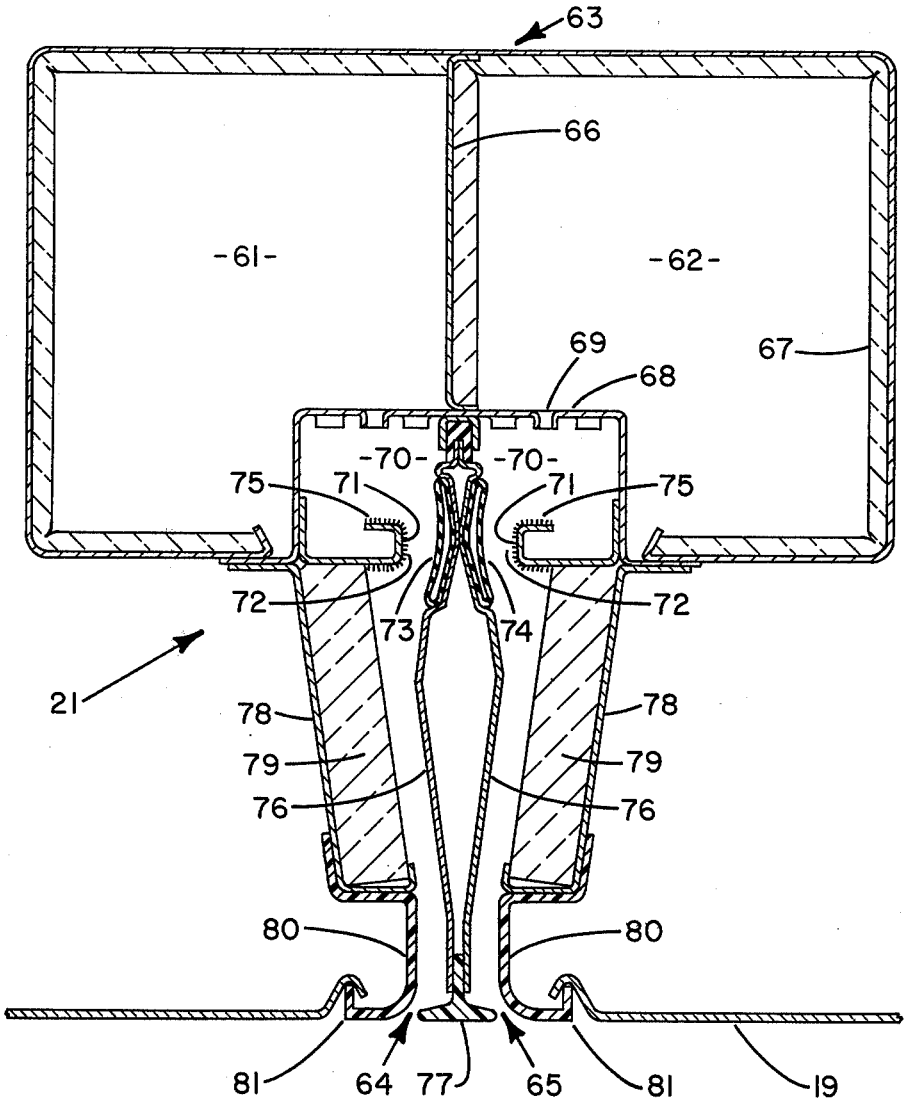
FIG. 3 illustrates a sectional view of a ceiling air terminal suitable for use in the air conditioning system of the present invention.

With reference to FIG. 3, there is shown a ceiling air terminal of a design suitable for use in the air conditioning system of the present invention. Such ceiling air terminal is operable to cause the air discharged therefrom to flow along the ceiling of the room.

Plenum 63 is ordinarily lined with a sound absorbing material 67, such as a glass fiber blanket. An air supply distribution plate 68 having a plurality of collared openings 69 therein is provided to evenly distribute the supply air from plenum 63 into distribution chamber 70 which is defined by the top and side walls of distribution plate 68. To provide an optimum room air discharge pattern, the air supplied to the distribution chamber from the plenum should have minimal nonvertical velocity components. Since the air supplied to the ceiling terminal is ordinarily introduced horizontally into the end of the terminal, there is a large horizontal velocity component to the air stream within the plenum. The distribution plate employing a large number of collared openings is very effective in providing an efficient, nonturbulent vertical diversion of the air stream from plenum 63 into distribution chamber 70. This minimizes noise generation within the terminal. The collars divert the horizontal velocity component of the air stream so that the velocity components of the stream within distribution chamber 70 are vertical.

The bottom of distribution chamber 70 includes aligned cutoff plates 71 which are provided with a curved surface 72 for engagement by bladders 73 and 74 to form a damper. The curved surfaces smooth the flow of air through the damper to minimize the pressure drop therethrough when the bladder is fully deflated and provide a lower noise level over the entire operating range of the terminal as bladder inflation is varied between a fully deflated position and a fully inflated position. Surface 72 is covered with felt 75 to further minimize noise.

By varying the inflation of the bladders, the area of the openings between the bladders and the cutoff plates may be varied. This feature can be utilized to provide a variety of modes of terminal operation. As noted before, it is desired to maintain a substantially constant discharge of primary air from the terminal, regardless of changes in the static pressure of the air in plenum portion 61, to compensate for transmission gains or losses. A suitable pressure responsive control may be employed to inflate bladder 73, in response to supply air pressure to reduce the area between the bladder and cutoff plate as duct pressure increases and to increase the area therebetween as duct pressure decreases. It should be noted that, as used herein, the term "substantially constant" includes decreasing the flow of primary air by a minimal amount to partially compensate for variations in the internal cooling or heating load of the room. The minimal decrease in flow may be obtained by varying the inflation of bladder 73 in response to changes in temperature in the room as sensed by a suitable thermostat.

As noted before, it is desirable to control discharge of air from plenum portion 62 to provide a constant type temperature under varying cooling loads. The inflation of bladder 74 is thereby selectively controlled by a thermostat responsive to room temperature to provide an increased quantity of air flow from plenum portion 65 as the cooling load increases and a decreased quantity of air flow from the plenum portion as the cooling load decreases. In FIG. 2, item 83 represents suitable controls to obtain the desired regulated inflation and deflation of bladders 73 and 74. Control 83 preferably includes a pressure regulator to control bladder 73 of a type known to those skilled in the art, for example the tupe disclosed in U.S. Pat. No. 3,434,409, issued in the name of Daniel A. Fragnito on Mar. 25, 1969. Control 83 may further include a second pressure regulator, in combination with a bleed-type thermostat, to control bladder 74, for example of the type disclosed in U.S. Pat. No. 3,595,475, issued on July 27, 1971, in the name of Daniel H. Morton.

Bladders 73 and 74 are adhesively mounted on a central partition assembly comprised of opposed generally convex plates 76 and a diffuser triangle 77. The plates have a V-shaped recessed area so the bladders are completely recessed within the plate when deflated. This provides a large area between the active walls of the bladders and the cutoff plates for maximum air flow therebetween. Further, the recessed bladder provides a smooth surface along plate 76 to minimize air turbulence.

By reference to the drawings, it may be seen that the walls of the bladders are concave. When bladders 73 and 74 are fully deflated, the active walls thereof are out of the air stream to minimize the possibility of bladder flutter. By recessing the bladder within the plate 76 and providing the bladder with the concave wall, the distance between the cutoff plate and the wall of the bladder is increased. This provides a greater opening between the bladder and the cutoff plate when the bladder is fully deflated for maximum air flow therebetween. Further, a large movement of the wall from a concave to convex position may be obtained without stretching the bladder material.

The damper mechanism is disposed a substantial distance upstream from the discharge openings in the terminal to provide sufficient space therebetween to absorb any noise generated by the damper mechanism. For maximum sound absorption, downwardly extending walls 78 which form air passages in conjunction with plates 76, are lined with sound absorbing material such as a glass fiber blanket 79. Outlet members 80 having outwardly flared portions 81 are fixed, as by welding, to walls 78.

The convex plates prevent direct, straight line passage of sound energy waves from the damper into the area being conditioned. The sound waves generated at the damper strike sound absorbing blankets 79 where they are absorbed, to prevent passage of noise from the terminal. The upper portion of the passageway formed between plate 76 and walls 78 has a constantly decreasing cross-sectional area in the direction of air flow and the lower portion of the passageway has a constantly increasing cross-sectional area in the direction of air flow. The change in the cross-sectional area of the passageway, in conjunction with the sound absorbing blanket, aids in the dissipation of sound energy which may be generated upstream of the passageway.

The ceiling air terminal hereinabove described is particularly suitable to discharge the primary air in the manner required to compensate for transmission gains or losses. In addition, the terminal discharges the secondary air, and in combination with a thermostat regulates the flow thereof to compensate for changes in the internal cooling load. For a more detailed explanation of the air terminal, reference may be made to U.S. Pat. No. 3,167,253, issued Jan. 26, 1965, Richard A. Church and Boris W. Haritonoff, inventors and U.S. Pat. No. 3,554,111, issued Jan. 12, 1971, Darwin G. Traver and Fred V. Honnold, Jr., inventors. Other terminals that operate to discharge the conditioned air therefrom so that the air will flow along the ceiling of the room may be employed without departing from the spirit of the invention.

Heretofore, if it has been desired to install an air conditioning system of the type disclosed herein, it has been necessary to provide two separate air terminals. In particular, it has been thought that, the primary air terminal should be placed below the window or on the floor adjacent to the peripheral wall, otherwise proper conditioning would not be obtained in the room or space.

Applicant has determined a ceiling air terminal may be employed satisfactorily to compensate for both transmission gains or losses and to compensate for variations in the internal cooling load. An air conditioning system including the ceiling air terminal as disclosed hereinabove reduces the installation cost of a dual conduit system without reducing the operating efficiency thereof.

It has been found that, in order to insure proper air circulation within the entire space, the primary air should be supplied at a temperature slightly above the level at which total compensation for transmission gains or losses will be accomplished. This will insure that at least a minimum flow of secondary air will be discharged from the terminal to obtain adequate circulation in the entire room.

While a preferred embodiment of the invention has been described and illustrated, the invention should not be limited thereto but may be otherwise embodied within the scope of the following claims.

I claim:

1. An air conditioning terminal operable to discharge conditioned air into an enclosed space, said terminal including means defining a plenum, means to provide a first conditioned air stream at a temperature which varies inversely to the temperature of the outdoor air to a first portion of said plenum, and means to provide a second conditioned air stream at a predetermined temperature level to a second portion of the plenum, said terminal further comprising:

a. means to maintain said first air stream in said first portion of said plenum separate from said second air stream in said second portion of said plenum; and b. discharge means connected to said plenum to discharge the conditioned air into said space, said discharge means including first diffuser means to direct the first conditioned air stream along the ceiling of said space towards the peripheral wall thereof, said first air stream compensating for transmission gains or losses through said wall, and second diffuser means to direct the second conditioned air stream along the ceiling of said space towards the interior portion thereof, said second air stream compensating for the remaining cooling load in said space, the volume of said second air stream being varied in accordance with changes in said cooling load, the volume of said first air stream discharged into said space being maintained substantially constant irrespective of changes in the pressure of said air in said first portion of said plenum.

2. The air terminal in accordance with claim 1 wherein the temperature of said first air stream is maintained above the level at which transmission gains or losses are exactly compensated for, to thereby maintain at least a minimum flow of said second air stream from said terminal.

* * * * *